US006100818A

United States Patent [19]

Di Berardino

[11] Patent Number: 6,100,818

[45] Date of Patent: Aug. 8, 2000

[54] VEHICULAR SECURITY PARKING SYSTEM

[76] Inventor: Anthony Di Berardino, 7 Don Court, Wantima Victoria 3152, Australia

[21] Appl. No.: 09/011,827

[22] PCT Filed: Aug. 23, 1996

[86] PCT No.: PCT/AU96/00532

§ 371 Date: Feb. 25, 1998

§ 102(e) Date: Feb. 25, 1998

[87] PCT Pub. No.: WO97/08392

PCT Pub. Date: Mar. 6, 1997

[30] Foreign Application Priority Data

Aug. 25, 1995 [AU] Australia ..... 30265/95

[51] Int. Cl.[7] ..... B60Q 1/48

[52] U.S. Cl. ..... 340/932.2; 340/933; 340/435; 49/49

[58] Field of Search ..... 340/932.2, 933, 340/938, 435; 49/35, 49, 131

[56] References Cited

U.S. PATENT DOCUMENTS

| | | | |
|---|---|---|---|
| 3,849,936 | 11/1974 | Garaci | 49/49 |
| 3,900,092 | 8/1975 | Page et al. | 194/241 |
| 3,968,596 | 7/1976 | Danin | 49/49 |
| 4,879,554 | 11/1989 | Diaz-Silveira | 340/932.2 |
| 5,365,694 | 11/1994 | Macaluso | 49/49 |

FOREIGN PATENT DOCUMENTS

| | | | |
|---|---|---|---|
| 256033 | 10/1963 | Australia . | |
| 80463/82 | 8/1982 | Australia | E01F 13/00 |
| 30265/95 | 3/1996 | Australia | E04F 13/14 |

*Primary Examiner*—Jeffery A. Hofsass
*Assistant Examiner*—Van T. Trieu
*Attorney, Agent, or Firm*—Pollock, Vande Sande & Amernick

[57] ABSTRACT

A secure vehicle parking space is provided with an adjustable barrier comprising a post that is located on the floor of the car space at the entry end. The post is movable from a prostrate position to an erect position and then is movable longitudinally of the car space toward the vehicle. A sensor in the post senses the distance of the post from the vehicle to locate the post a predetermined distance from the vehicle. The advantage is that a vehicle of any length can be securely restrained using a single erect post. The system is adapted for use with coin operated or other secure locking mechanisms.

8 Claims, 7 Drawing Sheets

VEHICULAR SECURITY PARKING SYSTEM

FIELD OF THE INVENTION

This invention relates to security barriers for vehicles particularly for use in car parks to prevent theft and unauthorized access.

BACKGROUND TO THE INVENTION

Most car parks if they provide any barrier to entry or exit provide a boom gate at the entry and exit points to the car park. This offers some security but is not sufficient to deter car theft in many instances. Individual restraints For car parking spaces have been used where a steel tube barrier is folded down to allow the vehicle to be parked and is lockable in an upright position when the car is parked or the space is being reserved. These restraints are manually operated and fixed in their position.

Remotely actuated vehicle barriers have been proposed for roadways and parking spaces but, as exemplified by GB patent 2282838 and German patent 4307045, these only move the barrier from one fixed non barrier position to a second fixed barrier position.

Although car parking spaces are generally of uniform dimensions, cars are not. Usually there is no restraint on any side of a car space or in some cases at the end of the space. Costs dictate that an ideal barrier system will provide a barrier at the two longitudinal ends of the space which is what most proposals have done. However these restraints are not sufficient to prevent cars of short body length from being maneuvered past the barrier. The only suggestion made to address this problem has been to PROVIDE side restraints to individual car spaces, which is expensive as well as inhibiting driver and passenger access to the vehicle.

It is an object of this invention to provide a cost effective secure car parking space which overcomes the above problems.

SUMMARY OF THE INVENTION

The present invention provides a secure car space which has an end for entry and exit from the space, a fixed barrier at the end opposite the entry, and which further includes at the entry end an adjustable barrier moveable from a non barrier position to a position in which it prevents egress of a parked vehicle characterized in that the barrier is able to be positioned the same distance from a vehicle regardless of the vehicle's length.

This invention is predicated on the realization that the car parking space need not be "one size fits all". By having a barrier which adjusts to the size of the vehicle the possibility that a small car can be maneuvered out of the car space is avoided.

In another aspect this invention also provides an adjustable barrier system including a) a vehicle barrier adapted to lie in an erect or prostrate position, and b) a conveying means adapted to move said vehicle barrier from a prostrate to an erect position and to move the erect vehicle barrier into close proximity to said vehicle to prevent its egress from the parking space.

For convenience the barrier is located at ground level when the car space is available. A central location adjacent the entry end of the car parking space is most effective. The controller or actuation means is most effectively located on a post at a central position at the other end of the car space, especially where there is no other barrier at that end.

The barrier can be any shape, but is most conveniently a post mounted on a conveyor in a track in the floor of the car space. The conveyor mechanism both raises the barrier into an erect barrier position and moves it to a location adjacent one end of the vehicle to prevent its being driven away. The post includes a sensor which senses the location of the vehicle and cooperates with the actuation means to provide a signal to stop the movement of the post at a predetermined distance from the parked vehicle.

The length of the conveyor and its location in the car space is determined by the length of the space and the length of the shortest and longest vehicles to be accommodated. The non barrier position is conveniently at the entry end of the parking space so that less movement of the post is required with longer vehicles and all movement of the erect post is toward the end of the parked vehicle.

The actuation means to be secure needs to be key, card or code activated. A mechanism which releases a key, or ticket to be used to initiate the raising and removal of the barrier could be used in commercially operated car parks. The mechanism could be coin operated or could issue a magnetic strip card which would need to be authorized before it could be used to remove the barrier.

BRIEF DESCRIPTION OF THE DRAWINGS

The invention will now be described in more detail with reference to the drawings in which.

DESCRIPTION OF THE PREFERRED EMBODIMENTS OF THE INVENTION

Figure 1:
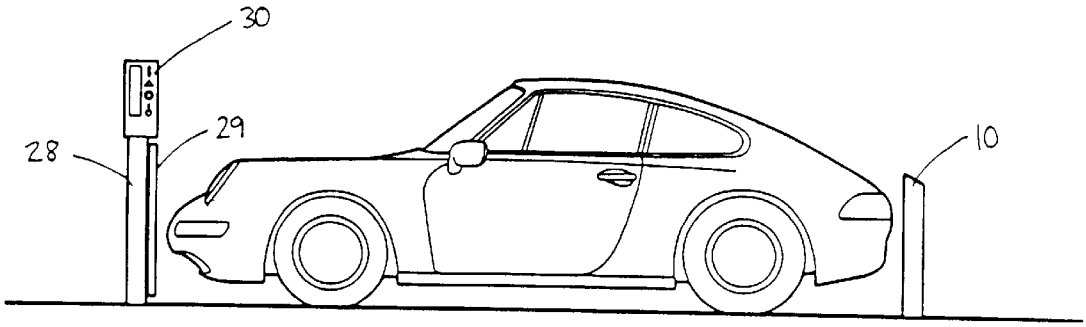
FIG. 1 is a side view and FIG. 2 is a perspective view of a car parking space with the barrier system of this invention.
Figure 2:
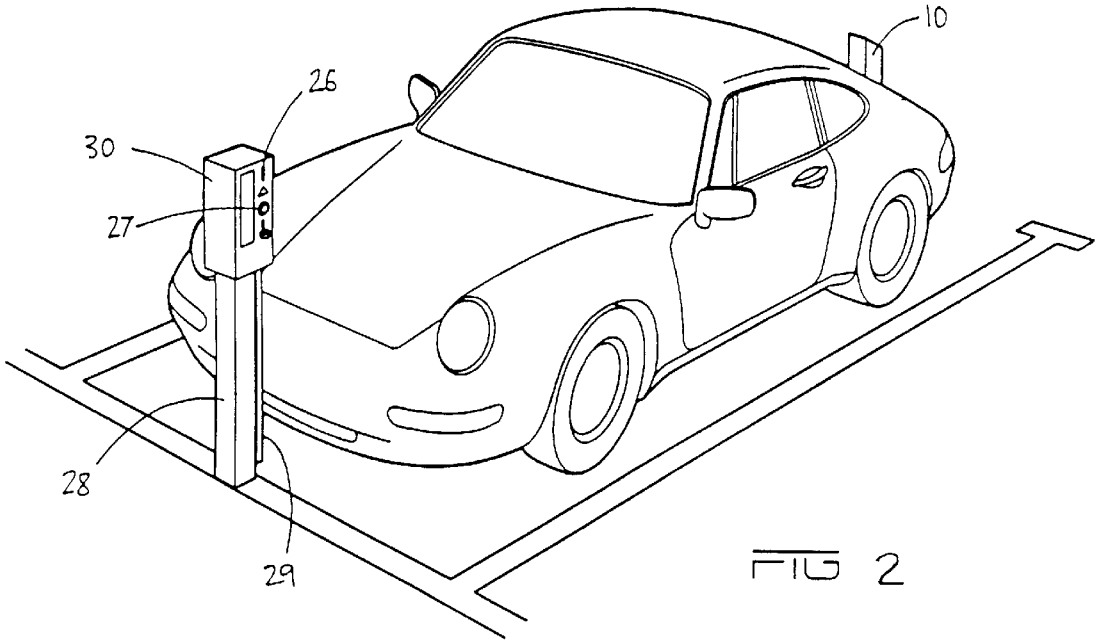
Figure 3:
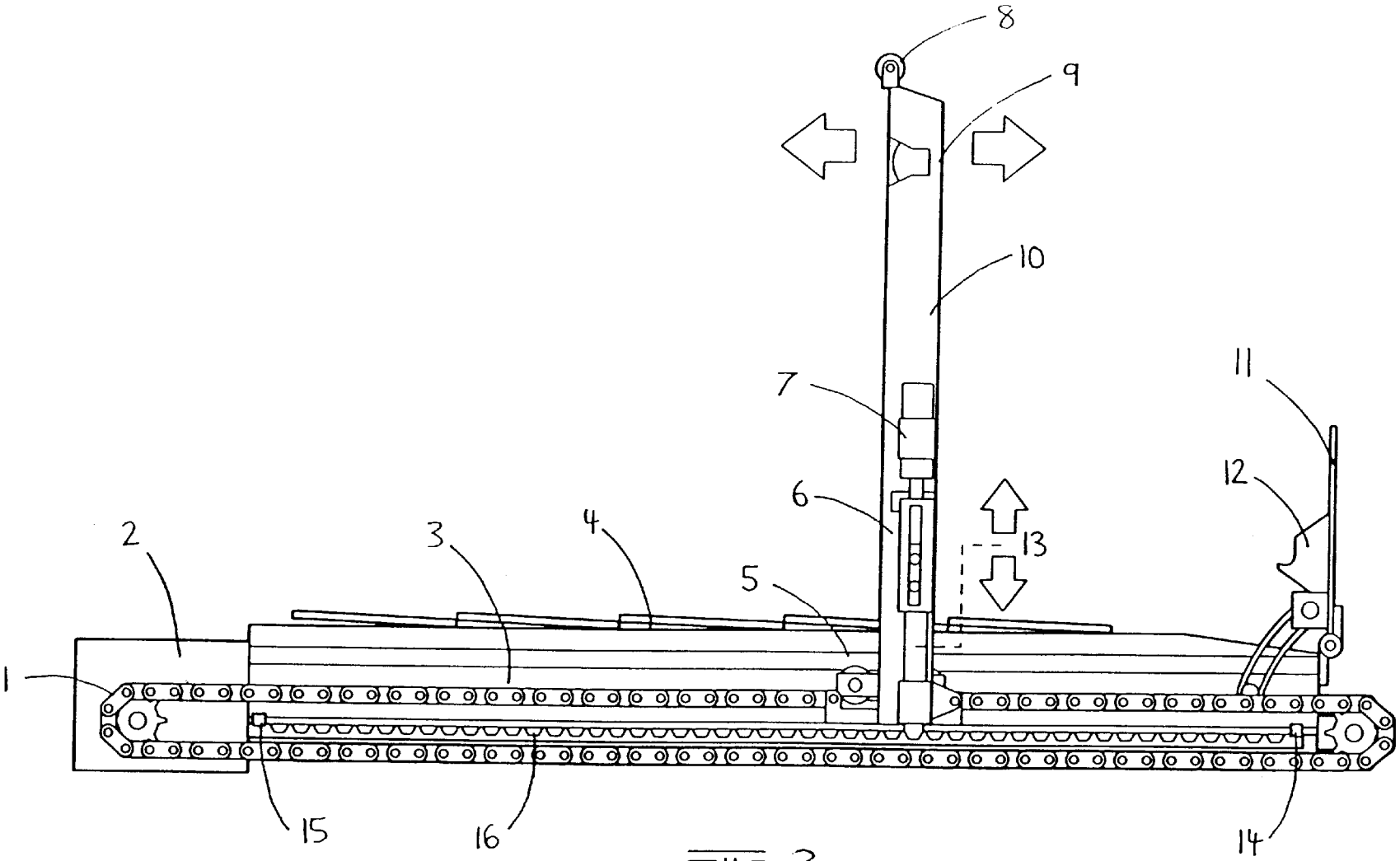
FIG. 3 is a side view of the mechanism of one embodiment of this invention.
Figure 4:
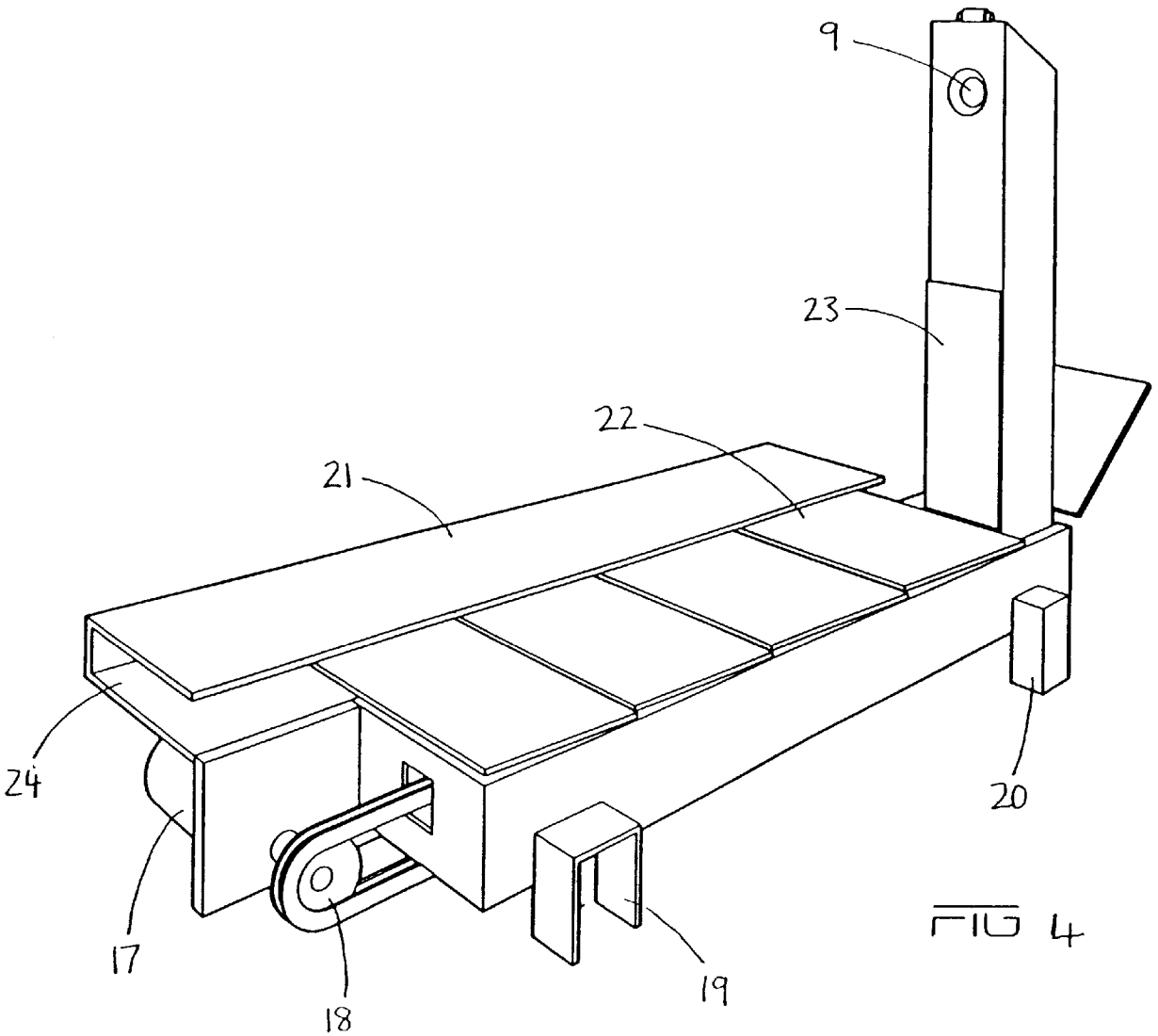
FIG. 4 is a perspective view of the post conveying apparatus of this invention.

The security barrier system as depicted in FIGS. 1 to 6 of the drawings provides a barrier post 10 mounted on a carriage 5 which acts as a conveyor for the barrier post. The actuation means includes a motor 2 and an elongated chain drive assembly which is an and endless loop chain 1 extending between two spaced apart sprocket wheels 18 mounted so that the axis of rotation of the sprocket wheels 18 are substantially horizontal parallel and in the same plane. The chain 1 rotates around the pair of sprocket wheels 18 in a substantially vertical plane. The carriage 5 is mounted on an upper chain section and is driven between the sprockets 18 by movement of the chain 5. The travel of the carriage 1 is restricted to be between the limiters 14 and 15 and the distance will generally be of the order of 2 meters to accommodate the length of short and long vehicles. The chain drive is mounted in a housing 4 [as shown in FIG. 4] which is mounted in the floor of the car space so that no more than 8 or 10 mm protrudes. The housing 4 may also include a chain guard and chain tensioning device. The housing extends longitudinally of the car space and is located centrally near the entry to the space. A vehicle when parked will straddle the housing which will extend out from beneath the vehicle.

Inside the housing 4 alongside the chain 1 is track 3 having a series of chamfered locking holes 16. At one end of the housing adjacent the chain 1 a guide plate 11 is pivotally connected to the housing. The guide plate 11 has a shaped abutment 12 on its inside face.

The motor 2 may have a slip clutch on its drive shaft to protect the motor from damage should the post 10 be accidentally hit by a vehicle. The housing also encloses the motor 2 and protects the conveyor mechanism from dust, dirt water and the passage of vehicles.

Figure 6A:
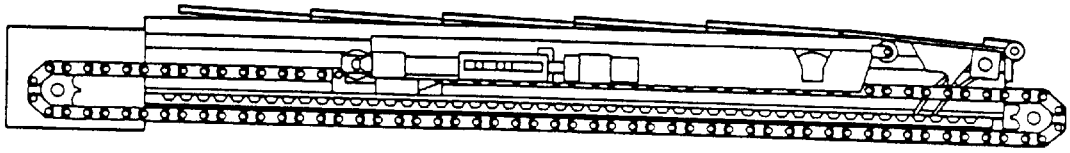
FIGS. 6*a* to 6*d* is a series of side views of the FIG. 3 embodiment showing the operational sequence of the invention.
Figure 6B:
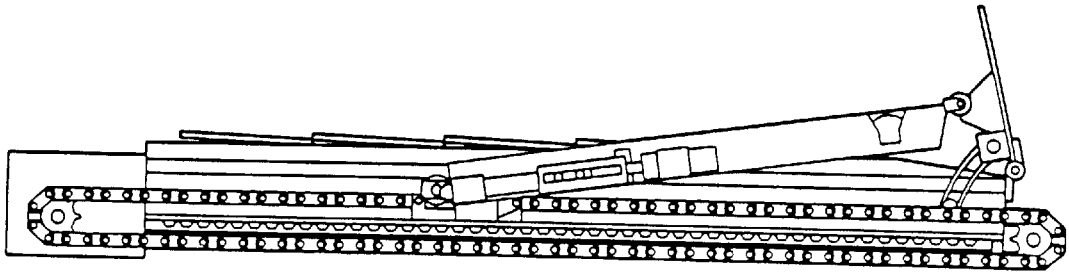
Figure 6C:
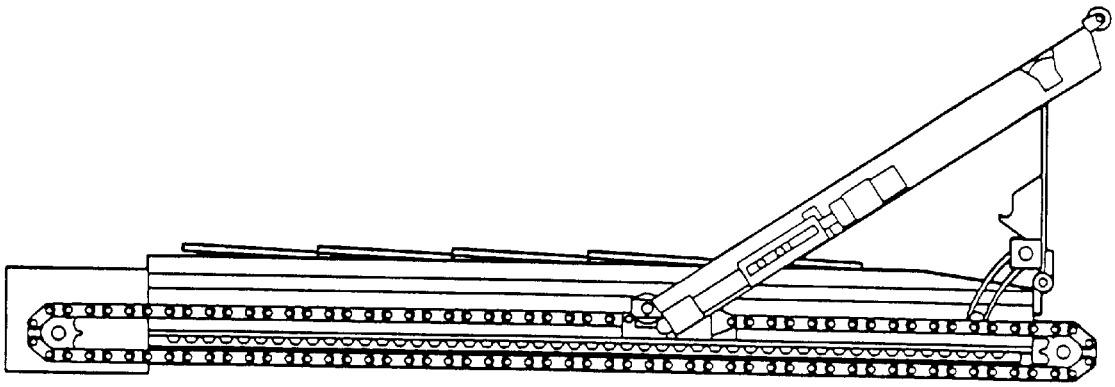
Figure 6D:
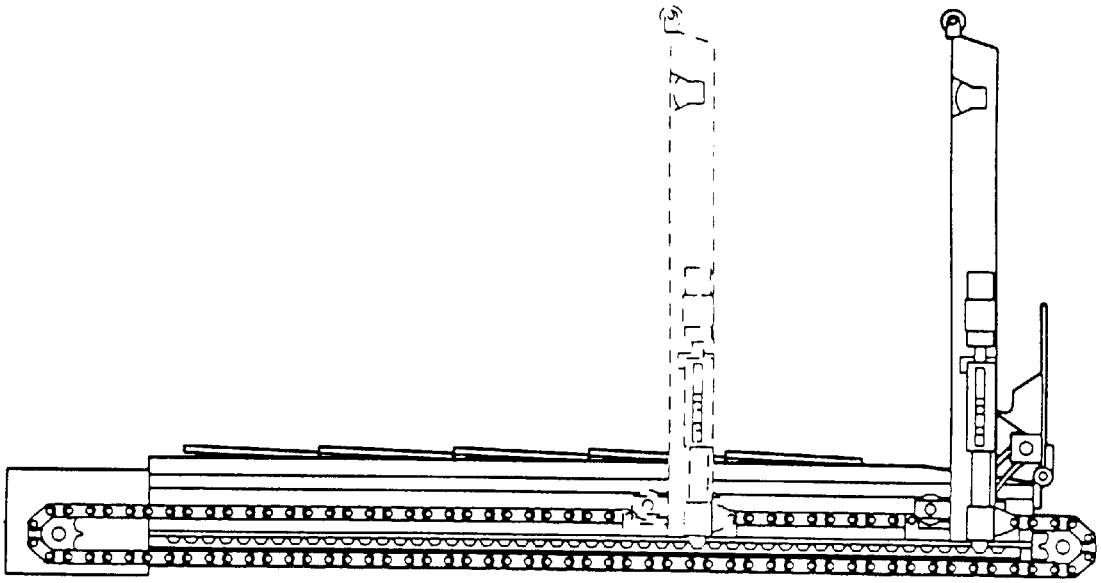

Post 10 is partially hollow and at one end is pivotally connected to the carriage 5 while at the other end it has an outwardly projecting roller S. The post 10 is able to lie substantially flat when the carriage 5 has been drawn at least the length of the post away from the abutment 12. With the chain in this position the guide plate 11 is able to pivot to a position where it lies substantially horizontal above the horizontal post 10. The abutment plate 12 extends upwardly from the guide plate's pivot connection to end in a hooklike projection adapted to abut the roller 8 at the end of post 10. The abutment plate 12 is slightly above the post 10 in the fully non barrier position as shown in FIG. 6*a* so that minimal force is required to rotate the guide plate 11. The chain 1 conveys the post toward the guide plate pivot and consequentially the roller 8 engages the hook of abutment plate 12 as shown in FIG. 6*b* to rotate the guide plate into a vertical position. The guide plate 11 is prevented from further rotation past the vertical position. As the chain continues to move carriage 5 toward the guide plate the roller 8 is forced out of the hook of abutment plate 12 and rides its inclined surface until it extends beyond the vertical guide plate 11 as shown in FIG. 6*c*. By optimizing the geometry of the abutment plate guide plate and post the force required by the motor is minimized and a 12 volt DC motor has been found to be sufficient. The post 10 continues its travel until it reaches a vertical orientation as shown in FIGS. 3 and 6*d*, at which time the limiter 14 retards further movement of the chain in that direction. Once the post is erect the motor reverses and the chain rotates in the opposite direction to convey the carriage 5 and the erect post 10 toward the parked vehicle.

Post 10 includes a sensor 9 in its upper portion which is used to determine the distance of the post from a vehicle. The post 10 also includes a locking mechanism comprising a retractable pin 13 driven by screw motor 7 in a housing 6. When the sensor 9 signals that the post is an appropriate distance from the vehicle the motor 2 stops and the screw motor 7 forces the pin 13 into a hole 16 in the track 3 to lock the post in its barrier position.

In order to minimize damage to the underside of the vehicle the housing can be mounted in a trough in a vehicle parking space. The trough can be covered by a series of spring mounted flaps 22 which are at alternating upper and lower positions and moveable into a sleeve 21 extending alongside the flaps 22. Movement of the post 10 toward the vehicle will force the flaps 22 to retract into the sleeve 21. A bilge pump may be used to maintain the trough reasonably dry for subsurface installation.

The adjustable barrier system as shown includes an activation mechanism 30 which is mounted on a pole 28. The pole 28 can be positioned at the non entry end of the vehicle parking space. Conveniently the pole has a bumper plate 29 facing the vehicle to protect the controls from impact damage. The pole 28 completes the barrier system in those car spaces not abutting a wall.

Figure 5:
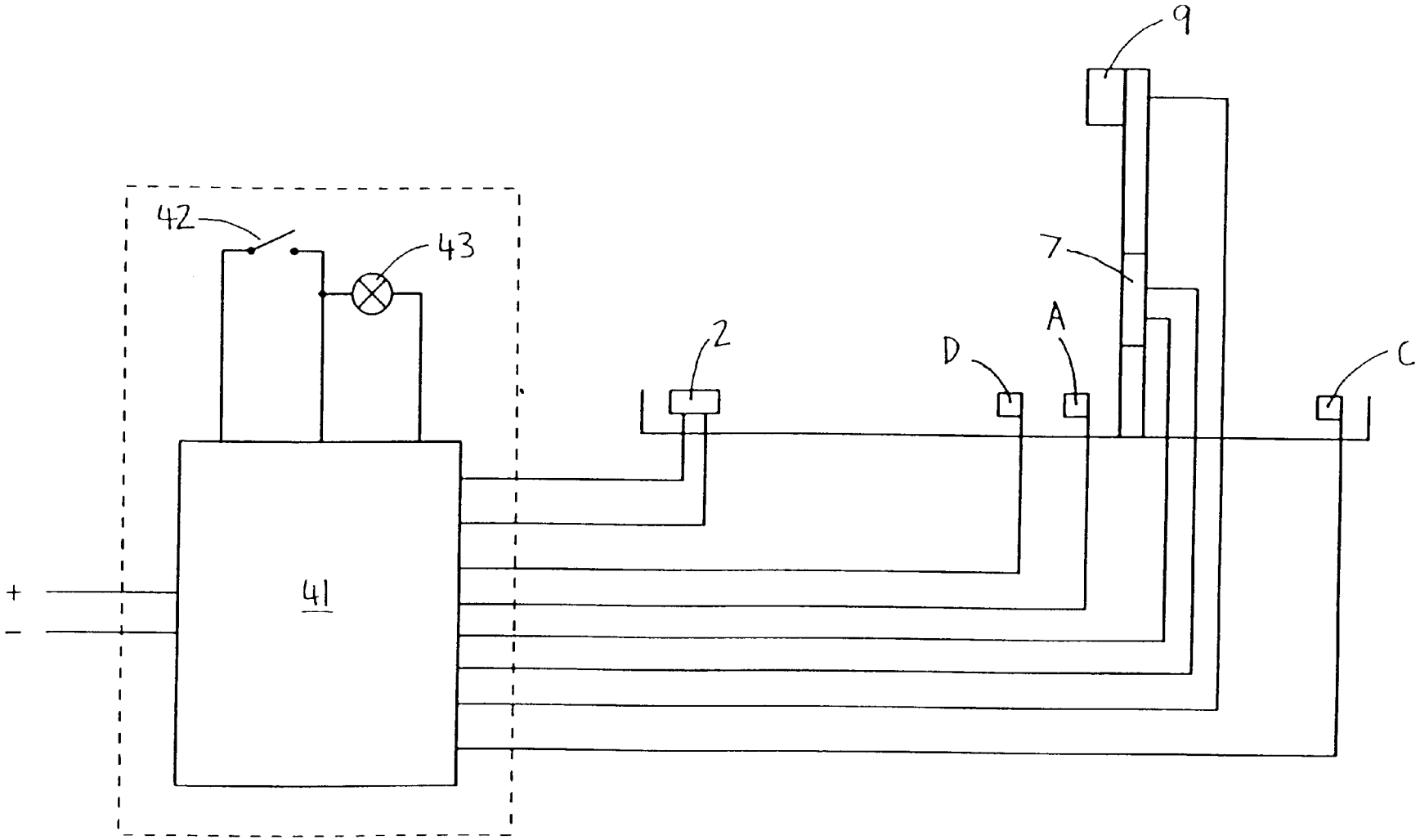
FIG. 5 is a circuit diagram of the control system for the embodiment of FIGS. 3 and 4.

In this embodiment the activation mechanism 30 includes a coin operated mechanism 27 and/or a timer mechanism 26 as well as the control circuit illustrated in FIG 5. Any suitable control mechanism can be adapted for use with the security barrier of this invention. In a private car park the control system could be a simple key operated switch to activate the motor 2. The embodiment as illustrated is for a commercial car park where a time based fee is payable to release the activation key when the car is parked.

Upon insertion of coins into the mechanism 27 the operating key can be used to activate motor 2 which drives the chain 1 to raise the post 10 behind the vehicle from its inoperative horizontal position and move the post 10 towards the vehicle until the sensor 9 signals that the vehicle is a predetermined distance from the post. At this point the locking pin 13 is driven into its adjacent hole 16 to lock the post into position adjacent one end of the vehicle. The vehicle is now restrained between the pole 28 and the post 10 and cannot be moved.

Looking at the electronic circuit in detail, there is a printed circuit board 41. A drive motor 2 is activated by the key switch 42 and drives the chain 1 to pull the post 10 towards the guide plate 11. Activation of the switch 42 lights the lamp 43 to show that the barrier system is active. The roller 8 hits the guide plate 11 causing the post 10 to lift the guide plate 11 to a nearly vertical position until the carriage 5 hits limit switch C at limit 14 which stops the drive motor 2 and initiates the pin motor 7 to drive the retractable pin 13 only into the carriage 5 at which point the pin hits limit switch A on the pin housing 6 and activates the pin motor 7. At this point the post 10 is secured in the vertical position but is still able to travel along the track 3. The controls then reverse the action of the drive motor 2 to reverse the rotation of chain 1 so that post 10 is drawn away from the guide plate towards the limit 15. Once the sensor 9 senses a car within the preset limit a pulse sent to the circuit board deactivates drive motor 2 and activates screw motor 7 to drive pin 13 into a recess 16 in the track 3. If no car is in the space or the vehicle is very short the limit switch D is activated when carriage 5 reaches point 15. If desired the activation of limit switch D can activate the circuitry to direct movement of the post 10 to return to limit point 14 at which point the retractable pin 13 is fully removed from the carriage 5 allowing the post 10 to return to a substantially horizontal position.

Otherwise the post 10 remains in the locked upright position until a key is inserted into the authorization means 30 activating a micro switch which initiates the pin motor 7 to retract the pin 13 out of the recesses 16 until the pin hits switch A at which point pin 13 is still located within the carriage 5 to retain the post in the upright position. The pin motor is then deactivated and the drive motor is activated to return the post 10 towards limit of travel at 14 at which position it hits limit switch C. The drive motor 2 stops and the pin motor 7 continues to retract the retractable pin 13 fully out of the carriage 5 and the drive motor is reactivated to leave the carriage 5 so that the post 10 can slide back down the guide plate 11 and return to a substantially horizontal position. To assist the return of the post 10 to the horizontal position, the post may include a spring urging a return to the horizontal position.

An alternative actuation means can be provided by replacing the chain 1 with a screw threaded drive or a worm drive. Rotation of the screw drive in one direction moves carriage 5 toward the guide plate 11 and after the limit switch c is activated the drive motor reverses and the worm rotates in the opposite direction to move the erect post 10 toward limit 15.

Figure 7:
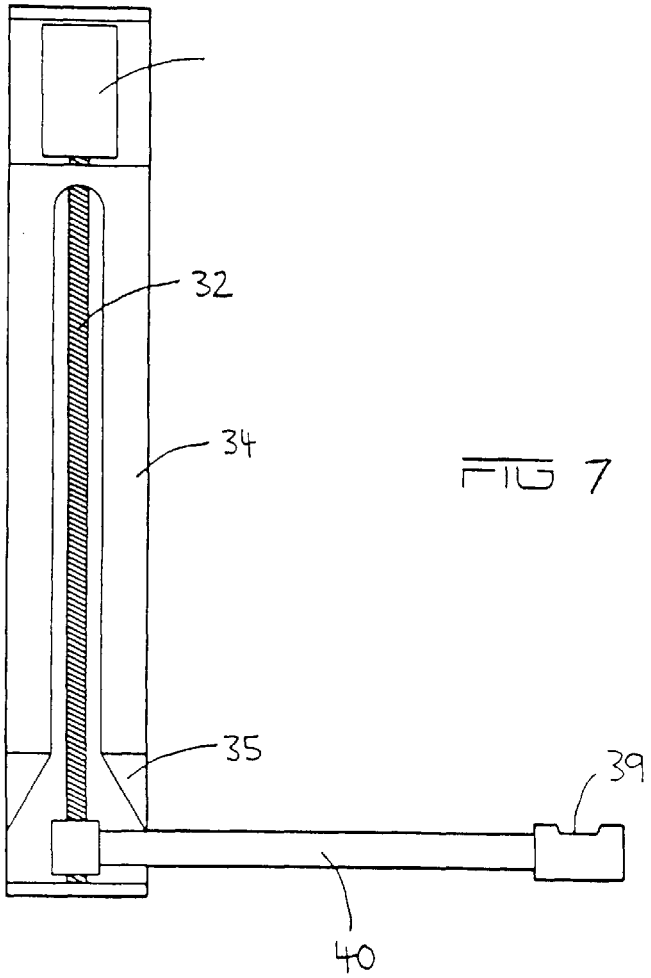
FIG. 7 is a plan view.
Figure 8:
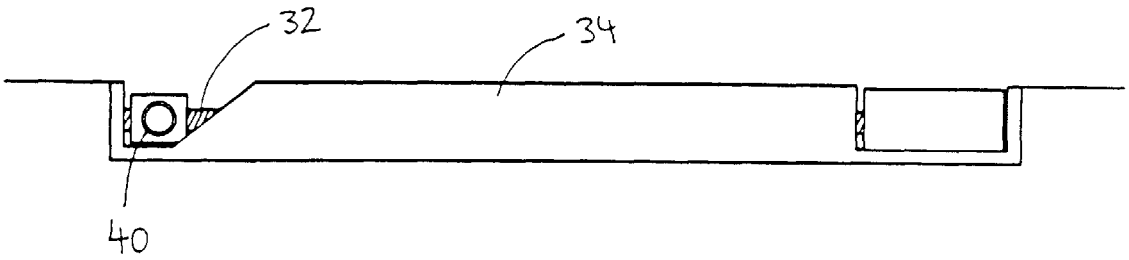
FIG. 8 is a side view of further embodiment of the invention.

A further alternative to the actuation means is illustrated in FIGS. 7 and 8. Again a screw thread or worm drive is used but by arranging the post and the housing the drive motor does need not have to rotate in one direction to erect the post then rotate in the opposite direction to move the post close to the vehicle. The worm drive 32 conveys the post 40 from a horizontal non barrier position to a position adjacent a vehicle by simply rotating in one direction. The post 40 extends at right angles from the worm drive and lies in a recess in the housing located at the end of the housing closest to the car space entry. The worm drive is located in a channel and the post 40 when erect moves between flanges 34 which define the top of the channel. The geometry of the recess and the portion 35 of the channel extending from the recess to the flanged section causes the post 40 to rise from the horizontal position to an erect position. Once erect the post can continue to move in the same direction until sensor 39 signals that the vehicle is the predetermined distance away and the drive stops and the post remains fixed in its position or a locking mechanism [similar to that in the embodiment of FIGS. 1 to 6] can be activated to lock the post 40 in position. The control circuits and the remainder of the system is the same as for the previous embodiments.

The adjustable barrier system of this invention may also include warning lights which flash while post 10 is upright in order to warn the vehicle driver and prevent accidental damage to the post 10. These warning lights may be located on the front pole 28 or separately mounted.

On return to the vehicle a number of ways to initiate movement of the POST 10 to a non barrier position can be used. In a private car park simply unlocking the post by use of the key would be sufficient. A more security conscious arrangement could utilize a central controller to send a signal to activate the switch to release the vehicle, once authorization had been given. In a commercial car park with time based fees a magnetic strip ticket or smart card could be activated by a cashier after payment and the authorized card used to activate the switch. Alternatively the timer could indicate the value of coins required in combination with the key to activate the release switch. Once the key is inserted it would be captured until released by the insertion of more coins.

From the above it can be seen that the present invention provides a new dimension of vehicle security and can be modified to suit a range of vehicle parking situations. The major advantage is that the secure car space of this invention caters to a wider range of vehicle lengths.

What is claimed is:

1. An adjustable barrier system for use in a secure vehicle parking space including a) a vehicle barrier moveable in a track mountable in or on the floor of said parking space and adapted to lie in an erect position or in a prostrate position relative to said parking space, and b) conveying means adapted to move said vehicle barrier from said prostrate position to said erect position and to move the erect vehicle barrier longitudinally into close proximity to a vehicle parked in said parking space to prevent egress of said parked vehicle from the parking space.

2. An adjustable barrier as claimed in claim 1 which further includes a sensor mounted on said vehicle barrier and a controller which activates erection and movement of said vehicle barrier, said controller being responsive to said sensor sensing that the vehicle barrier is a predetermined distance from said vehicle to stop longitudinal movement of said barrier and to activate locking of said barrier in a position which prevents vehicle egress from said parking space.

3. An adjustable barrier as claimed in claim 1 in which said conveying means is an elongated endless chain incorporating a support for said vehicle barrier.

4. An adjustable barrier as claimed in claim 3 in which said vehicle barrier comprises a post which in said prostrate position lies along the top of said chain, movement of the chain in a first direction being operative to erect the post while movement in the opposite direction moves the post toward the parked vehicle until the post is a predetermined distance from the vehicle.

5. An adjustable barrier as claimed in claim 1 wherein said vehicle barrier in said prostrate position extends laterally of said track, the track having a geometry which guides said vehicle barrier into said erect position as said conveying means moves said vehicle barrier toward the parked vehicle.

6. A secure parking space for a vehicle, a) said parking space having an end for entry to and exit of a vehicle from the parking space, b) a fixed barrier at an end of said parking space opposite said entry end, c) said entry end having an adjustable barrier which includes a post moveable in a track in or on the floor of said parking space, d) said track extending longitudinally into said parking space from a position approximately central to said entry end of said space, e) said adjustable barrier being moveable in said track from a non-barrier position in which said post is prostrate, to a barrier position in which said post is in an erect state that prevents egress of a vehicle from said parking space, f) said barrier also being moveable longitudinally of said parking space so as to be positioned the same distance from a vehicle in said parking space regardless of the vehicle's length.

7. A secure parking space as claimed in claim 6 which also includes means to activate the adjustable barrier to move into a barrier position which prevents egress of a parked vehicle, and locking means to lock the barrier into said barrier position.

8. A secure parking space as claimed in claim 7 which includes a sensor which senses the distance of the adjustable barrier from the parked vehicle, and a controller which activates movement of the adjustable barrier until the sensor senses that the barrier is a predetermined distance from the parked vehicle.

* * * * *